US005205247A

United States Patent [19]

Hoffman

[11] Patent Number: 5,205,247

[45] Date of Patent: Apr. 27, 1993

[54] INFINITELY VARIABLE LIFT CAM FOLLOWER WITH CONSISTENT DWELL POSITION

[76] Inventor: Christopher J. Hoffman, 857 Colonial Ct., Birmingham, Mich. 48009

[21] Appl. No.: 827,448

[22] Filed: Jan. 29, 1992

[51] Int. Cl.[5] ..... F01L 1/12

[52] U.S. Cl. ..... 123/90.16; 123/90.20; 123/90.21

[58] Field of Search ..... 123/90.15, 90.16, 90.20, 123/90.21, 321, 347, 348; 251/229, 251, 252

[56] References Cited

U.S. PATENT DOCUMENTS

| | | | |
|---|---|---|---|
| 1,490,613 | 4/1924 | Leport et al. | 123/90.21 |
| 2,097,883 | 11/1937 | Johansson | 123/90.21 |
| 2,934,052 | 4/1960 | Longenecker | 123/90.16 |
| 4,261,307 | 4/1981 | Oldberg | 123/90.15 |
| 4,469,056 | 9/1984 | Tourtelot, Jr. et al. | 123/90.16 |
| 4,723,515 | 2/1988 | Burandt | 123/90.16 |
| 4,724,809 | 2/1988 | Burandt | 123/430 |
| 4,770,060 | 9/1988 | Elrod et al. | 74/655 L |
| 4,771,742 | 9/1988 | Nelson et al. | 123/90.17 |
| 4,836,162 | 6/1989 | Melde-Tuczai et al. | 123/321 |
| 4,898,130 | 2/1990 | Parsons | 123/90.2 |
| 4,917,058 | 4/1990 | Nelson et al. | 123/90.17 |

FOREIGN PATENT DOCUMENTS

| | | | |
|---|---|---|---|
| 2214567 | 9/1989 | United Kingdom | 123/90.2 |

OTHER PUBLICATIONS

Automotive Engineering, Oct. 1991, vol. 99, No. 10, pp. 12-16 "Variable Valve Actuation".

Automotive Engineering, Nov. 1991, vol. 99, No. 11, pp. 67-68 "Tech Briefs: Super-Economy Lean-Burn Engines From Mitsubishi & Honda".

Automotive Engineering, Nov. 1991, vol. 99, No. 11, pp. 73-74 "Global View Points".

*Primary Examiner*—Willis R. Wolfe

*Attorney, Agent, or Firm*—Basile and Hanlon

[57] ABSTRACT

An apparatus for cyclically actuating an actuation member in response to rotation of a cam shaft having a cam carried thereon is disclosed. The apparatus preferably includes a shaft capable of angular rotation through at least a predetermined arc, a cam follower carried by the shaft for rotation therewith and the cam follower pivotally connected to the shaft in a manner allowing reciprocation of the cam follower independent of angular movement of the shaft. The cam follower preferably having a first contact surface with the cam and a second contact surface with the valve operating mechanism. The first and second contact surfaces preferably formed as curved surfaces with a predetermined radius.

26 Claims, 6 Drawing Sheets

INFINITELY VARIABLE LIFT CAM FOLLOWER WITH CONSISTENT DWELL POSITION

FIELD OF THE INVENTION

The invention relates to an apparatus for cyclically actuating an actuation member in response to rotation of a cam shaft having a cam carried thereon, and more particularly, to an apparatus for operating at least one valve to vary valve lift distance and extent of duration of peak valve opening relative to an operating cycle of an internal combustion engine.

BACKGROUND OF THE INVENTION

Prior known devices for modifying the operation of a valve in an internal combustion engine can be seen in U.S. Pat. No. 4,917,058, No. 4,836,162, No. 4,771,742, No. 4,770,060, No. 4,724,809, No. 4,723,515, No. 4,469,056, No. 4,261,307 and No. 2,934,052. All of these known devices require complex rocker arm or cam follower configurations, and/or complex cam shaft configurations. For example, U.S. Pat. No. 4,723,515 discloses three separate cam surfaces for each valve, which greatly increases the cost of manufacturing the cam shaft. The same is true for U.S. Pat. No. 4,469,056 which also discloses three cam surfaces for each valve, and also discloses a complex mechanical structure for following the three cam surfaces and actuating the valve. U.S. Pat. No. 2,934,052 discloses a simpler mechanism for actuating the valve, however this mechanism operates as a simple switch mechanism to change between a first position in which the valve operating means is actuated responsive to rotation of the first cam and a second position in which the valve operating means is actuated responsive to rotation of a second cam.

These prior known devices suffer from disadvantages associated with high manufacturing cost of the components required to practice the invention and lack of adjustability, having been designed for only one or two pre-set configurations.

SUMMARY OF THE INVENTION

It is therefore desirable in the present invention to resolve the perceived deficiencies of the prior known devices. More particularly, it is desirable in the present invention to provide a simple device for varying the operation of valves in an internal combustion engine. Furthermore, it is desirable to provide a device capable of cyclically actuating an actuation member in response to rotation of a cam shaft having a cam carried thereon, where the cam shaft and cam are of a simple configuration to reduce the manufacturing costs thereof. In addition, it is desirable in the present invention to provide a cam follower mechanism that is simple in construction and has a minimum number of mechanical connections and moving parts to simplify the cost of manufacturing the mechanism and to increase the reliability of the mechanism in use.

Conventional internal combustion engines include a piston reciprocally disposed in a cylinder, the piston being suitably connected to a crank to impart rotary motion to a shaft responsive to reciprocal motion of the piston in the cylinder. A plurality of such cylinders and pistons are typically provided in a conventional engine, such as those used for automotive, marine and aircraft applications. Most large engines are four-stroke cycle internal combustion engines, while smaller internal combustion engines for other applications, such as non-passenger vehicles, may be in the form of a two-stroke cycle internal combustion engine. The internal combustion engines may be powered by various fuels, such as diesel, gasoline, low pressure gas, hydrogen or any other comparable source of combustible fuel for generating energy.

Each cylinder of an engine is generally provided with an intake port for admitting fuel thereto and an exhaust port from which the gases resulting from combustion of the fuel in the cylinder are exhausted. Intake and exhaust valves are respectfully provided for closing and opening the intake and exhaust ports at appropriate times. In the case of gasoline engines, each cylinder is provided with a spark plug for igniting the fuel, whereas in diesel engines, the fuel is ignited during injection by the high temperature resulting from high compression.

In four-stroke cycle internal combustion engines, four strokes of the piston provide a complete cycle of operation of the engine. In the first stroke, the piston moves downwardly from the top of its travel (referred to as top dead center) to the bottom of its travel (referred to as bottom dead center), the intake valve being opened and the exhaust valve closed during this first stroke which is thus referred to as the intake stroke; during the intake stroke, a charge of fuel mixture is drawn into the cylinder over the piston head through the intake valve. At the end of the intake stroke, both intake and exhaust valves are closed and the piston moves upwardly to compress the fuel between the piston head and the cylinder head. At or near the top of the compression stroke, the charge of fuel is ignited, by a spark plug in the case of a spark ignition engine, or during injection of the fuel by the heat of compression in the case of a diesel engine, and the piston then moves downwardly on the power stroke. At the bottom of the power stroke, the exhaust valve is open with the intake valve remaining closed and the piston then moves upwardly on the exhaust stroke to force the gases resulting from combustion of the fuel out of the exhaust port, thereby completing the cycle. The exhaust valve closes at the end of the exhaust stroke and the intake valve again opens to initiate a new cycle of operation.

The above-described timing of the intake and exhaust valves would be ideal for a relatively slow speed engine only. At high speeds, the intake charge of fuel resists movement into the cylinder due to the inertia of its mass, and thus at the bottom of the intake stroke, a partial vacuum exists instead of a cylinder full of fuel. Furthermore, at the bottom of the intake stroke, the charge of fuel has high velocity entering the cylinder and thus, if the intake valve remains open during part of the compression stroke, there will be a ramming effect to force more fuel into the cylinder. At the end of the power stroke, there is considerable pressure remaining in the cylinder, this high pressure existing during part of the exhaust stroke and thus requiring additional work in order to pump the exhaust gases out of the cylinder. Thus, in order to relieve this high exhaust pressure condition, it is necessary to open the exhaust valve during part of the power stroke so as to allow the exhaust gases to start moving out of the cylinder before the exhaust stroke begins. Due to the speed of the exhaust stroke, considerable velocity is imparted to the gases exhausted through the exhaust port, and therefore it is desirable to maintain the exhaust valve open during part of the intake stroke. Furthermore, if the intake valve is open prior to the end of the exhaust stroke, a scavenging effect takes place which aids in the removal of all of the exhaust gases and in the entry of the new charge of fuel into the cylinder. The period between the opening of the intake valve and the closing of the exhaust valve is referred to as valve overlap.

The valve timing which is appropriate for high speeds is, however, undesirable for low speed operation since with the intake valve open after bottom dead center, the piston will pump some of the charge of fuel back into the intake port during the compression stroke. Furthermore, the valve overlap permits the exhaust gas to return to the cylinder after the end of the exhaust stroke, and will also permit the exhaust gases to contaminate the new charge of fuel since the exhaust pressure is always greater than the intake pressure in a naturally aspirated engine. In addition, there is a loss of available power during part of the power stroke due to early opening of the exhaust valve.

In the design of conventional four-stroke cycle internal combustion engines intended for operation of a substantial range of speed and power, such as those employed in automotive applications, the selection of an appropriate valve timing inherently involves a compromise. High speed performance is sacrificed for low speed performance and vice versa. It will now be readily seen that it is desirable to provide a valve operating mechanism in which the valve timing can be selectively changed over an infinite range. With the present invention, appropriate valve timings can be provided for low speed and high speed operations and can be infinitely adjusted between the low speed and high speed ranges in order to obtain the desired operating characteristics. Furthermore, since the present invention has infinite lift capability, it is anticipated that an engine may be throttled by the valve lift alone, making it possible to eliminate the throttle body of a conventional fuel injected engine when using the present invention. In addition, improved swirling of fuel-air mixtures can be achieved with the present invention at small valve lift distances.

While various arrangements have been proposed for providing variable valve operation, such arrangements have either been unduly complex, have involved mechanical stress problems, or have not in fact provided stable variable valve operation, or both. It is therefore desirable in the present invention to provide an improved mechanism for operating valves. It is further desirable to provide an improved mechanism for operating reciprocal valves of the poppet type. Furthermore, it is desirable in the present invention to provide an improved valve operating mechanism for four-stroke cycle internal combustion engines which selectively provides an infinitely variable valve open position.

The present invention is an apparatus for cyclically actuating an actuation member in response to rotation of a cam shaft having a cam carried thereon. The apparatus includes cam follower means continuously engaging the cam and having an axis of reciprocation parallel to an offset from an axis of angular displacement. The cam follower means transmits infinitely variable reciprocating movement to the actuation member to move the actuation member from a consistent first position to an infinitely variable second position. In its preferred form, the present invention includes a shaft capable of angular rotation through at least a predetermined arc, a cam follower carried by the shaft for rotation therewith and pivot means for connecting the cam follower to the shaft while allowing reciprocation of the cam follower independent of angular movement of the shaft. The cam follower can include an external curved surface engageable with the cam and the actuation member. The pivot means is preferably disposed generally between a cam contact surface and an actuation member contact surface.

In an internal combustion engine having a rotatable cam shaft, a cam on the cam shaft, a combustion chamber and a reciprocal valve member for opening and closing a valve port in communication with the combustion chamber, the present invention is used to cyclically actuate the valve member. The present invention can include valve operating means for reciprocating the valve member, cam follower means cooperable with the cam and engaging the valve operating means. Displaceable pivot means supports the cam follower means with respect to the cam and the valve operating means. The cam follower means preferably includes a first contact surface with the cam and a second contact surface with the valve operating means. The first and second contact surfaces are formed as curved surfaces with a predetermined radius. The pivot means is generally disposed between the first and second contact surfaces. The valve operating means can include the valve stem, a hydraulic lifter disposed between the cam follower means and a stem of the valve member, or a rotatable lever having a first contact surface with the cam follower means and a second contact surface with the cam for actuating the valve operating means to exhaust air from the combustion chamber at top dead center when operating as an air brake. The first and second contact surfaces disposed along at least a portion of a smooth circular surface of the cam follower means can be positioned at an angle from one another measured from a center of the circular surface falling in the range of not less than 60° and not more than 280° inclusive, wherein this angle preferably falls in a range from 60° to 135° inclusive. In an alternative embodiment, the cam follower means can include a cam lobe clearance notch for providing early valve closure at slow engine speed.

The present invention discloses an apparatus for operating at least one valve to vary time and extent of duration of a valve opening relative to an operating cycle of an internal combustion engine. The valve controls the flow of fluid with respect to a combustion chamber of the internal combustion engine. The combustion chamber is defined by a cylinder in the engine and piston means movable in the cylinder for varying the volume thereof. The engine also includes a rotatable cam shaft driven in timed relation with the speed of the engine. Means for transmitting reciprocating movement from the cam to the valve can include cam follower means engaging the valve operating means and being operable to effect movement of the valve to an open position. The apparatus can include a swing shaft disposed having a longitudinal axis of rotation parallel to and offset from the cam shaft. The swing shaft capable of angular rotation through a predetermined arc. The longitudinal axis of the swing shaft perpendicular to and offset from a longitudinal axis of the valve stem. The cam follower means is carried by the swing shaft and has an external smooth curved surface with a predetermined radius. The curved surface is simultaneously and continuously engageable with the cam and the valve operating means for transmitting reciprocating movement at any position along the predetermined arc of angular rotation of the swing shaft. Pivot means connect the cam follower means to the swing shaft. The pivot means has an axis of rotation parallel to and offset from the longitudinal axis of the swing shaft. The pivot means is disposed generally between the cam and valve operating means for allowing reciprocating rotation of the cam follower means independent of angular rotation of the swing shaft. The apparatus of the present invention may also include a valve lash adjustment screw connected to the pivot means allowing adjustment of the position of the cam follower means with respect to the cam and valve operating means, such that the valve operating means continuously biases the cam follower means into contact with the cam. In the present invention, angular movement of the swing shaft to position the pivot means closer to the cam increases the amount of valve lift, while angular movement of the swing shaft to position the pivot means closer to the valve operating means decreases the amount of valve lift.

Other desirable characteristics and features of the invention will become apparent by reference to the following specification and to the drawings.

DETAILED DESCRIPTION OF THE PREFERRED AND ALTERNATIVE EMBODIMENTS

Figure 1C:
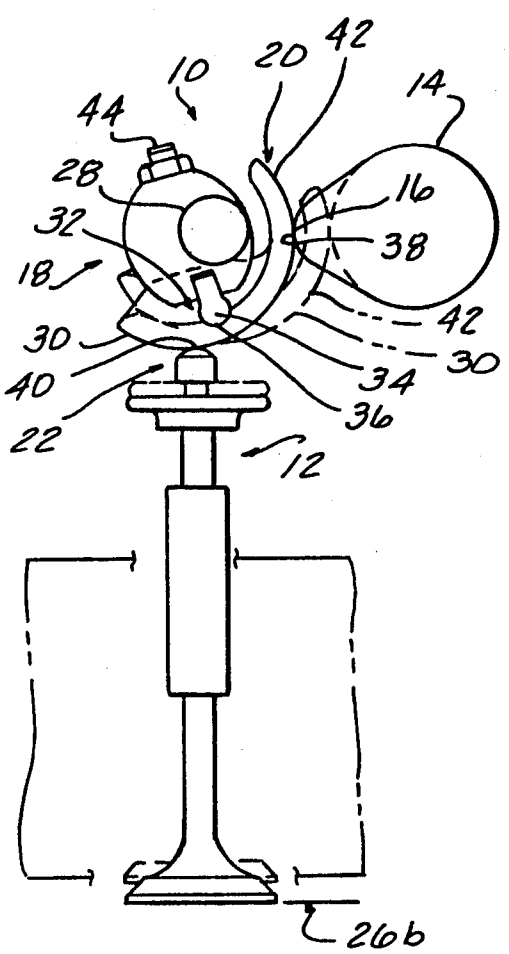
FIG. 1C is a simplified side elevational view of the present invention with the cam follower pivot disposed at a minimum swing angle with the valve reaching peak lift at 2° before the cam lobe reaches the horizontal axis.
Figure 1B:
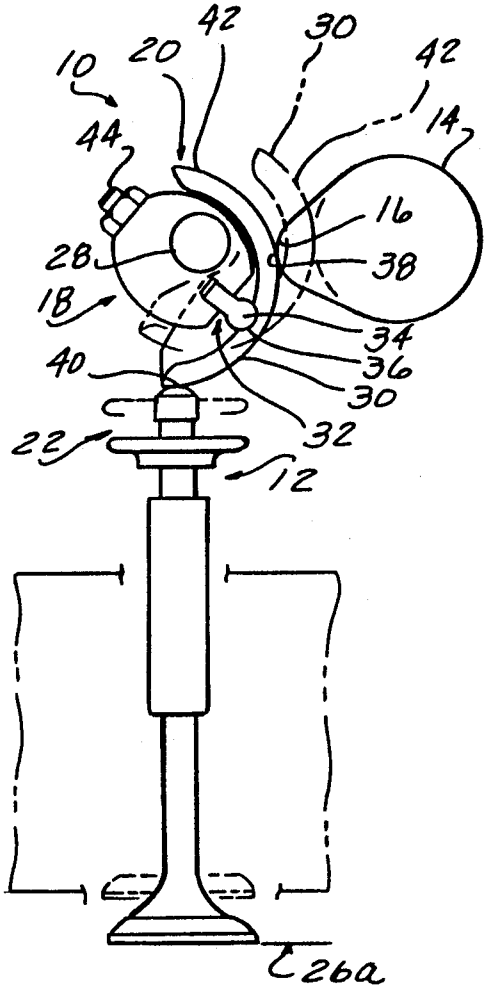
FIG. 1B is a simplified side elevational view of the embodiment shown in FIG. 1A with the valve reaching peak lift at 10° before the cam lobe reaches the horizontal axis.
Figure 1A:
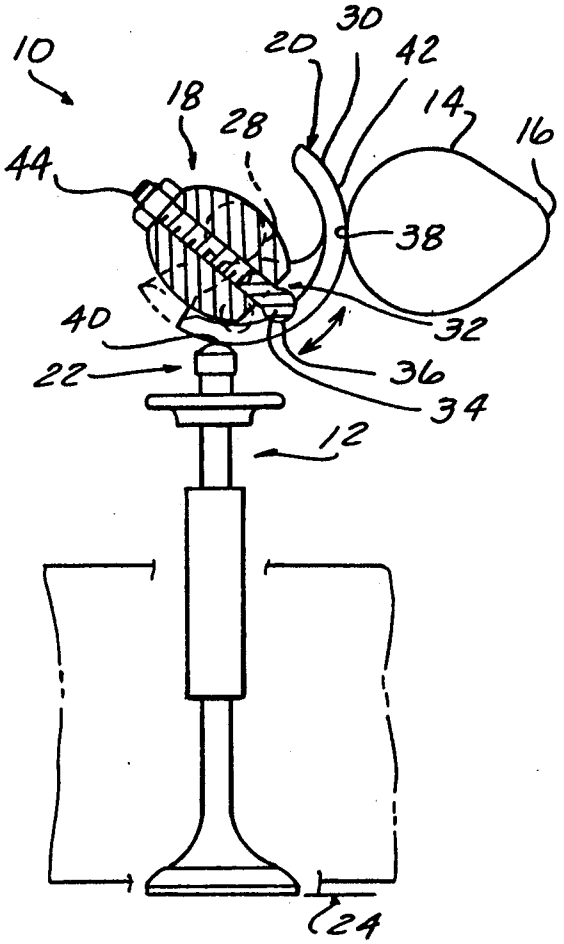
FIG. 1A is a simplified side elevational view of an infinitely variable valve lift cam follower mechanism according to the present invention with a cam follower pivot disposed at a maximum swing angle while in a dwell position.

An apparatus, generally designated as 10, for cyclically actuating an actuation member 12, such as a reciprocal valve member for opening and closing a valve port in communication with the internal combustion chamber of an internal combustion engine is shown in FIGS. 1A, 1B and 1C. The actuation member or valve 12 is cyclically actuated in response to rotation of a cam shaft 14 having a cam 16 carried thereon. The valve 12 can control the flow of fluid with respect to a combustion chamber of an internal combustion engine where the combustion chamber is defined by a cylinder in the engine and piston means movable in the cylinder for varying the volume thereof. The rotatable cam shaft 14 is typically driven in timed relation with a speed of the internal combustion engine. Means, generally designated as 18, for transmitting reciprocating movement are provided. The means 18 can include cam follower means 20 engaging valve operating means 22 and being operable for effecting movement of the valve 12 to an open position.

The cam follower means 20 continuously engages the cam 16 and has an axis of reciprocation parallel to and offset from an axis of angular displacement. The cam follower means 20 transmits infinitely variable reciprocating movement to the actuation member 12 to move the actuation member 12 from a consistent first position 24 to an infinitely variable second position 26. The cam follower means 20 is preferably biased by the actuation member 12 into continuous engagement with the cam 16 while in any position of reciprocation and any position of angular displacement. Angular positions for the cam lobe 50 and the pivot means 32 referred to hereinafter will be defined in reference to a 0° position identified as the right-hand side, as illustrated in the figures of an axis normal to the longitudinal axes of both the cam shaft and the swing shaft, with the angle increasing in the clockwise direction.

The cam follower means 20 can include shaft means 28 capable of angular rotation through at least a predetermined arc. A cam follower 30 is carried by the shaft means 28 for rotation with the shaft means 28. Pivot means 32 connect the cam follower 30 to the shaft means 28. The pivot means 32 allows reciprocation of the cam follower 30 independent of angular movement of the shaft means 28. The pivot means 32 can take the form of at least a partial cylindrical surface 34 and shoe 36 for receiving the partial cylindrical surface 34. The pivot means 32 is preferably disposed generally between a cam contact surface 38 and an actuation member contact surface 40. The cam follower 30 preferably includes an external curved surface 42 engageable with the cam 16 and the actuation member 12. Preferably, the first contact surface 38 and second contact surface 40 can be formed as curved surfaces having a predetermined radius. In the preferred form of the invention, the predetermined radius starts from a single point for both the first and second contact surfaces, 38 and 40 respectively. The first and second contact surfaces, 38 and 40, are preferably disposed along at least a portion of the smooth circular surface 42 of the cam follower 30 at an angle from one another measured from a center of the circular surface 42 falling in a range of not less than 60° and not more than 280° inclusive, and where preferably, the angle falls in a range from 60° to 135° inclusive. The pivot means 32 is generally disposed between the first and second contact surfaces, 38 and 40 respectively, such that the pivot means may act as a fulcrum about which the cam follower 30 pivots. However, in its preferred form, the cam follower 30 is held in position with respect to the cam 16 and actuation member 12 by partial cylindrical surface 34 and corresponding shoe 36. It should be recognized that the cylindrical surface 34 and shoe 36 combination can be easily replaced with a pivot pin and bore combination or with an integral offset shaft connection in place of the pivot pin with the cam follower pivotally connected to the offset shaft, similar to a crank shaft and piston arm connection.

Figure 6:
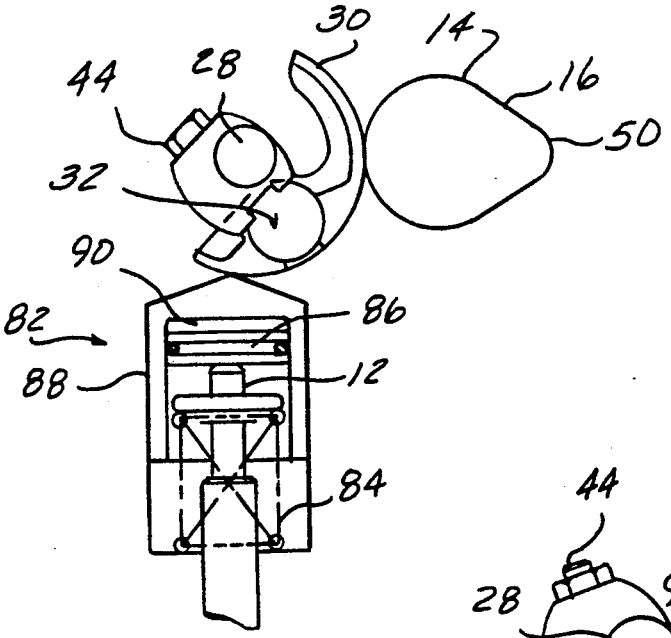
FIG. 6 is a simplified schematic view of an infinitely variable valve lift cam follower mechanism according to the present invention where the valve operating means is a hydraulic valve lifter.

The infinitely variable valve lift cam follower mechanism 10 according to the present invention as shown in FIGS. 1A–1C provides a cam follower means 20 having a pivot means 32 displaceable through an arc of approximately 30° for changing the valve 12 operation. For purposes of this description, the terms horizontal and vertical are used for illustration purposes with reference to the structure as depicted in the drawing figures, and is not intended to be construed as limiting the scope of the invention to these orientations. It should be clear that in actual application of the present invention, the longitudinal axes of the cam shaft 14, swing shaft 28 and pivot means 32 may be disposed in different orientations with respect to one another, however the longitudinal rotation axis of the cam shaft 14 and swing shaft 28 will define a plane sometimes referred to herein as a horizontal plane or axis as depicted, even though it may not be horizontal in actual use, and where a vertical plane or axis, as sometimes referred to herein, is normal to the previously defined horizontal plane or axis even though it may not be vertical in actual use. As shown in FIG. 1A, the cam follower 30 is shown in solid line at a maximum swing angle of approximately 60° from the 0° position previously defined and in a dwell position. As the cam rotates clockwise as shown from FIG. 1A to FIG. 1B, the cam lobe reciprocates or rotates the cam follower 30 about the pivot means 32 reaching maximum valve lift with the pivot means at the maximum swing angle as shown in solid line in FIG. 1B. The phantom lines in FIGS. 1B and 1C show the cam follower in the dwell position. The phantom lines of FIG. 1A indicate the relative position of the cam follower 30 when in a minimum swing angle for valve stem position A or being generally vertically disposed at a 90° position from the 0° position previously defined, with the pivot means 32 generally in vertical alignment with the longitudinal axis of the shaft means 28 as depicted in FIG. 1C. This 90° position swing angle (0° with respect to vertical) for valve position A results in the valve lift as shown in FIG. 1C. If FIGS. 1B and 1C are compared it can be seen that as the swing angle changes from 60° to 90°, the moment of peak valve lift moves from 170° (10° advanced from horizontal) as shown in FIG. 1B to 178° (2° advanced from horizontal) as shown in FIG. 1C. A valve lash adjustment means 44 is also shown in FIGS. 1A–1C providing for adjustment travel of the pivot means 32 with respect to the longitudinal axis of the shaft means 28, cam shaft 14 and valve operating means 22. Adjustment can also be provided automatically by employing a valve lifter as shown in FIG. 6.

Figure 2:
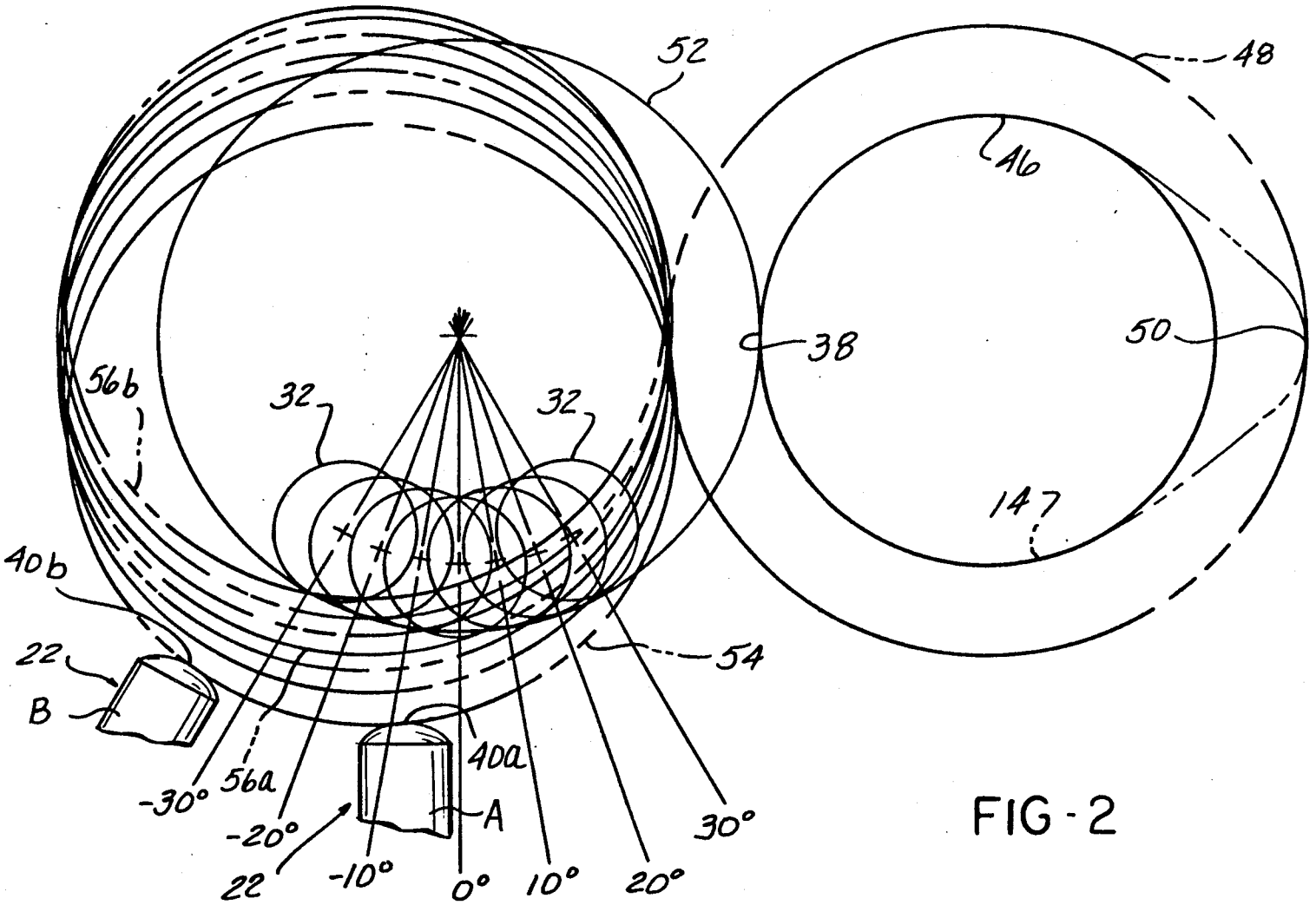
FIG. 2 is a detailed schematic representation of possible valve stem placements with respect to the cam follower according to the present invention and showing possible pivot positions for the cam follower and the range of motion that the cam follower is driven through when in the various positions shown.

Referring now to FIG. 2, a detailed schematic view of the apparatus 10 according to the present invention is shown. To the right as depicted, the dwell circle 46 of the cam shaft 14 is depicted inside the maximum lift circle 48 swept by the cam lobe 50. The cam follower circle 52 at dwell intersects the dwell circle 46 at a first contact point on the first contact surface 38. The maximum valve lift circle 54 is shown with its corresponding cam follower longitudinal pivot axis at 60° from the 0° position previously defined, or in other words displaced 30° counterclockwise from the vertical axis of the shaft means 28 as depicted. The maximum valve lift circle 54 is applicable for valve operating means 22, such as those disposed at position A or position B, having a longitudinal axis offset and perpendicular to the longitudinal axis of the shaft means 28. Position A generally corresponds to a valve operating means, such as valve stem 22, disposed in a generally vertical orientation as depicted, and position B corresponds to an alternative valve position disposed at approximately 30° in a clockwise direction from valve position A with respect to the cam follower circle 52. The maximum valve lift circle 54 has a second contact surface **40*a* or 40*b* depending upon the position selected for the valve 12. A minimum valve lift circle 56*a* would correspond to a longitudinal axis of the pivot means 32 being in a 90° position with respect to the 0° position previously defined with the valve stem placement in position A, while the minimum valve lift circle 56*b* would correspond to the rotational axis of the pivot means 32 being disposed at an angular orientation of 60° with respect to the 0° position previously defined (30° in the clockwise direction from vertical with respect to the longitudinal axis of the shaft means 28) and with the valve stem in position B. The minimum valve lift circle 56*b* would not apply to the valve stem disposed in position A, since positioning the longitudinal axis of the pivot means 32 in the same plane as the longitudinal axis of the valve operating means 22, such as a valve stem of the valve 12**, would result in no actuation of the valve at all.

It should be apparent to those skilled in the art by closely examining FIG. 2 that the valve operating means 22 can be positioned in almost any angular position around the longitudinal axis of the shaft means 28 provided sufficient clearance is allowed for the cam shaft rotation. It should be noted that with the cam shaft rotating in a clockwise direction as depicted in FIG. 2 maximum lift is accomplished by the cam lobe 50 at the 170° position with respect to the 0° position previously defined, or in other words 10° in advance of the plane defined by the longitudinal axes of the shaft means 28 and cam shaft 14, when the cam follower pivot means 32 is in a 60° position with respect to the 0° position previously defined (30° orientation in the counterclockwise direction from vertical). When the valve operating means 22 is disposed in position B, and the cam follower pivot means 32 is disposed at 60° position with respect to the 0° position previously defined (30° in a clockwise direction from vertical) the maximum lift is achieved by the cam lobe 50 at a position 3° after passing through the plane containing the longitudinal axes of the shaft means 28 and cam shaft 14, or in other words at a 183° position with respect to the 0° position previously defined. Therefore, the valve operation can be shifted from 10° advanced peak valve lift opening position to a 3° retardation of peak valve lift opening position by angularly shifting the longitudinal axis of the pivot means 32 about the longitudinal axis of the shaft means 28. Regardless of the angular displacement of pivot pin 32, the valve will always open and close at the same angular cam position, unless the radius defining the curved surfaces, 38 and 40, is different as disclosed in one of the alternative embodiments depicted in FIGS. 9 through FIG. 12.

It should also be noted that at low engine speed, the effort necessary to compress the valve spring is reduced due to the mechanical advantage, since the effective lever arm of the cam follower 30 from the longitudinal axis of the pivot means 32 to the cam is longer. Thus drag is reduced and less torque is required to turn the cam shaft 14, providing better fuel economy and less torque to start the engine. It should also be apparent from close examination of FIG. 2 that the opposite valve operation could be achieved by placing a valve operating means on the upper half of the cam follower circle 52 and valve lift circles 54 and 56. Of course, the operation of the valve would be reversed where the maximum valve lift circle 54 would become the minimum valve lift circle and the minimum valve lift circle 56 would become the maximum valve lift circle on that side of the cam follower circle 52 and separate cam follower biasing means may be required in some locations. It should also be noted that it would be undesirable to position the longitudinal axis of the pivot means 32 anywhere in a range from 135° to 225° with respect to the 0° position previously defined, or in other words in the range of 45° in either clockwise or counterclockwise direction with respect to the left-hand side of a horizontal plane passing through the swing shaft center line and the cam shaft center line as depicted in FIG. 2, since this would lead to a locking or non-functional interaction between the cam follower and the cam lobe 50.

Figure 3A:
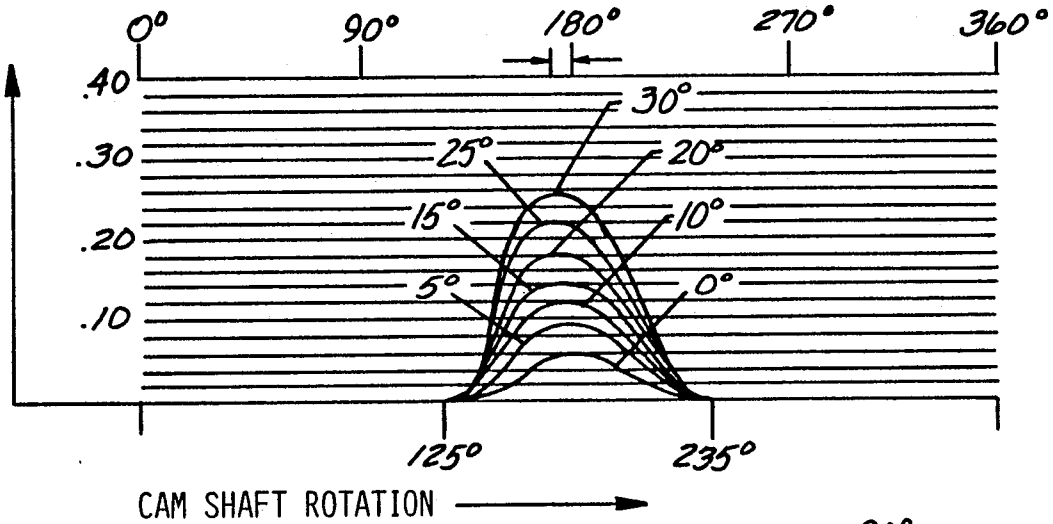
FIG. 3A is a graph showing valve lift in inches corresponding to cam shaft rotation in degrees from a 0° position starting with the cam lobe on the right-hand side of a horizontal axis with a valve stem at position A as shown in FIG. 2.
Figure 3B:
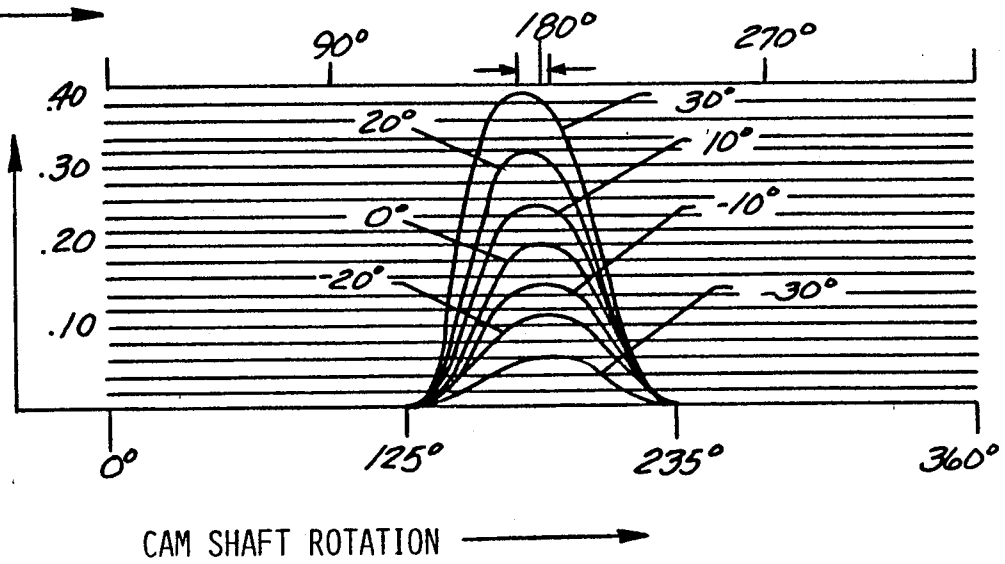
FIG. 3B is a graph showing valve lift in inches corresponding to cam shaft rotation in degrees from a 0° position starting with the cam lobe on the right-hand side of a horizontal axis with the valve stem at position B as shown in FIG. 2.

The geometric configuration shown in detail in FIG. 2 results in the possibility of obtaining valve operating characteristics as graphically depicted in FIG. 3A and FIG. 3B. FIG. 3A graphically depicts the valve lift in inches on the vertical axis and the cam shaft rotation in degrees along the horizontal axis. The cam shaft rotation beginning at a 0° orientation with the lobe positioned on the horizontal axis to the right as depicted in FIG. 2 and rotating in a clockwise direction. The point of valve opening occurs at approximately 125° with the valve stem or other valve operating means 22 disposed in position A as depicted in FIG. 2. Valve closure typically occurs at 235° of rotation. Various valve lifts are possible by swinging the longitudinal axis of the pivot means 32 from a 60° position with respect to the 0° position previously defined (in other words in vertical alignment with the longitudinal axis of the shaft means 28) to a 120° position with respect to the 0° position previously defined (in other words 30° angular offset in the counterclockwise direction from the vertical axis). In FIG. 3A some of these valve lifts are shown as curves with the lowermost curve showing the 90° position with respect to the 0° position previously defined (vertical alignment with the longitudinal axis of shaft means 20) with each curve adding 5° of rotation of the longitudinal axis of the pivot means 32 in the counterclockwise direction up to a maximum of 30° less angular displacement, or in other words a 60° position with respect to the 0° position previously defined, which is the uppermost curve. As can be seen, the peak valve lift is obtained 10° in advance or early with respect to the 180° cam shaft rotation position.

FIG. 3B shows the valve lift in inches on the vertical axis and the cam shaft rotation in degrees along the horizontal axis with valve operating means 22 disposed at position B. The point of opening again occurs at approximately 125° and the point of valve closure occurs at approximately 235°. Due to the change in valve stem or valve operating means 22 position, it is possible to swing the longitudinal axis of the pivot means 32 from a 120° position with respect to the 0° position previously defined (30° in the clockwise direction with respect to vertical), through to a 60° position with respect to the 0° position previously defined (30° in the counterclockwise direction with respect to vertical alignment with the longitudinal axis of the shaft means 28), providing approximately 60° of total angular movement. Therefore, the various valve lift curves shown in this graph depict the angular location of the longitudinal axis of the pivot means 32 by starting with pivot means 32 in the 120° position with respect to the 0° position previously defined (30° in the clockwise direction with respect to vertical) as the bottom most curve. Each successive curve depicts the longitudinal axis of the pivot means 32 positioned in 10° counterclockwise increments. The uppermost curve being at the 60° position with respect to the 0° position previously defined (30° in the counterclockwise direction with respect to vertical alignment). As can be seen, the peak valve lift for the 60° position with respect to the 0° position previously defined (30° in the counterclockwise direction with respect to vertical alignment) occurs 10° early, while the peak valve lift of the 120° position with respect to the 0° position previously defined (30° in the clockwise direction with respect to vertical) occurs 3° after the 180° orientation of the cam lobe 50. Regardless of valve lift, the point of valve opening and closing remains constant at 125° and 235° of cam rotation respectively. As valve lift approaches peak lift, the time at which peak valve lift occurs happens up to 10° early and is adjustable from 10° early to 3° late.

Figure 4:
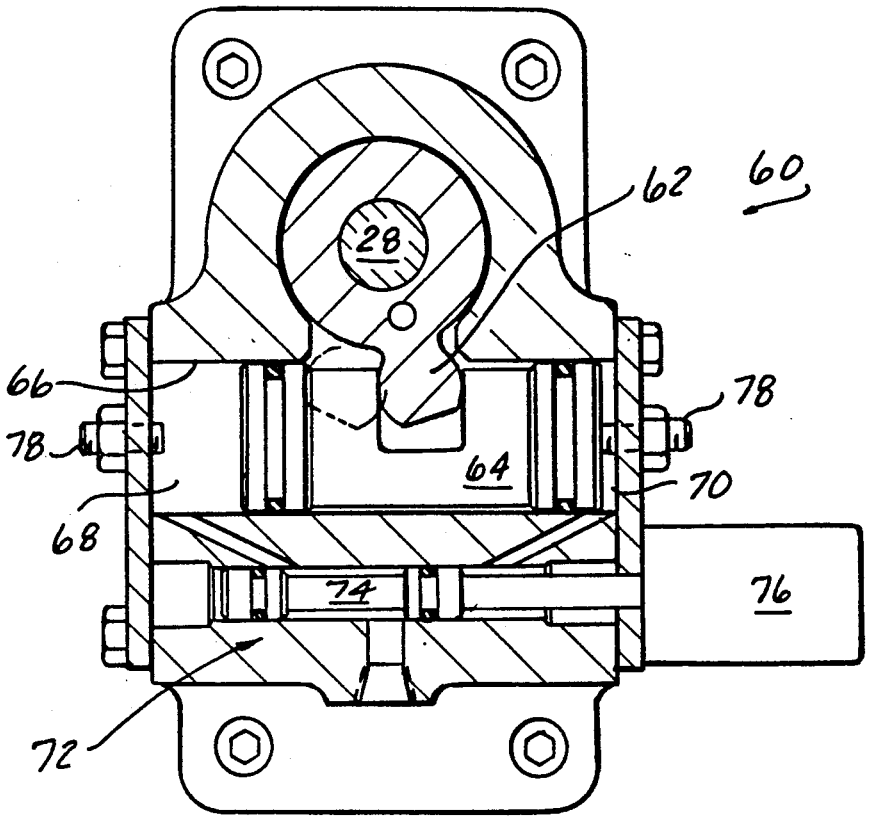
FIG. 4 is a side elevational view of a swing shaft actuator assembly.
Figure 5:
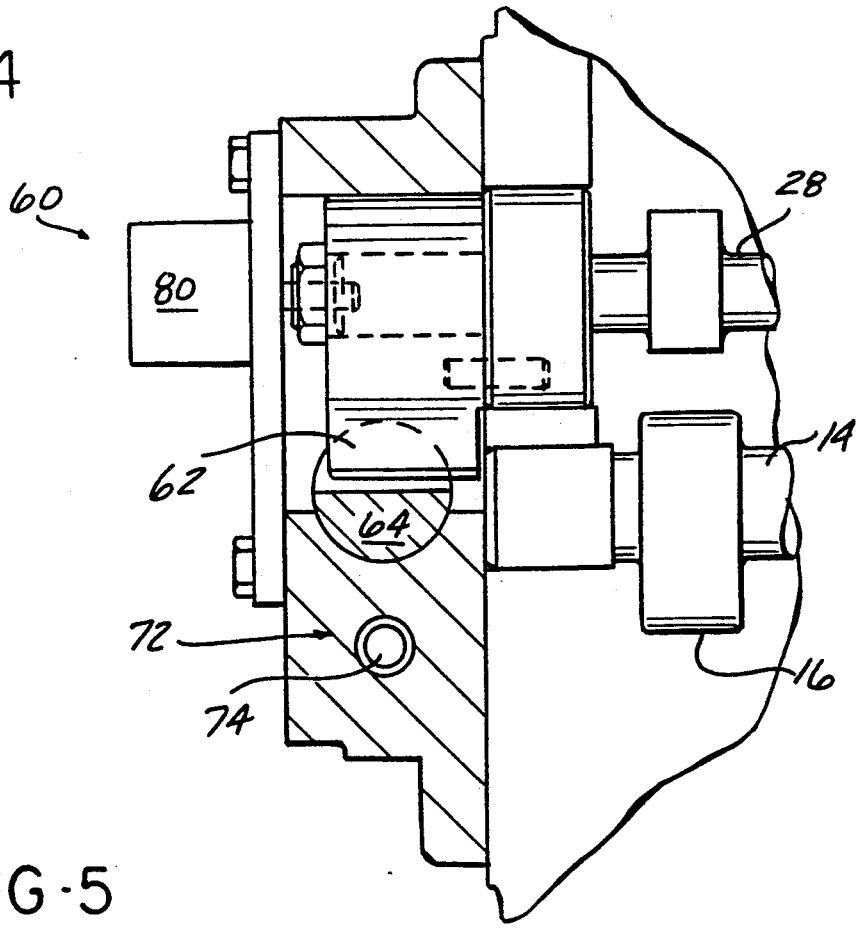
FIG. 5 is a cross-sectional view of the swing shaft actuator assembly as shown in FIG. 4.

Referring now to FIGS. 4 and 5, driving means 60 is depicted for driving the shaft means 28 in rotation about a longitudinal axis to a selected position on a predetermined arc. The driving means 60 can include a crank arm 62 connected to the shaft means 28 and a piston 64 connected to the crank arm 62 for driving the crank arm 62 and attached shaft means 28 in rotation through the predetermined arc. A cylinder housing 66 encloses the piston 64 allowing reciprocal movement between first and second end limits of travel. The piston 64 and cylinder housing 66 defining first and second expandable fluid pressure chambers 68 and 70 respectively. Means 72 is provided for selectively expanding and retracting the first and second chambers, 68 and 70 respectively, to drive the piston 64 in a desired direction. The expanding and retracting means 72 can include a shiftable spool valve 74 operable to apply pressurized fluid to one chamber while evacuating pressurized fluid from the other chamber. Solenoid means 76 may also be provided for actuating the spool valve 74. Stop means 78 may be provided for adjusting the idle and top speed by adjusting the outer end limits of travel for the piston 64. By shifting spool valve 74, oil pressure or pressurized hydraulic fluid can be applied to either end of the piston 64. The piston 64 drives the crank arm 62 to rotate the swing shaft 28 through a predetermined arc of rotation. Encoder means 80 may also be provided for shaft position feedback to control means (not shown).

A typical hydraulic valve lifter means 82 is depicted in FIG. 6. The hydraulic valve lifter means 82 being one possible form of valve operating means 22, if the cam follower 30 does not act directly on the valve stem of the actuation member 12. As previously mentioned, the actuation member 12 biases the cam follower 30 continuously into engagement with cam 16 on cam shaft 14 with bias means 84, such as a valve spring. Bias means 84 may act through the valve stem of the actuation valve 12 or may act through a hydraulic valve lifter, such as shown at 82. The hydraulic valve lifter means 82 typically would include a piston member 86 connected to an outer end of the valve stem and disposed within a housing 88 enclosing a fluid chamber 90.

Figure 7:
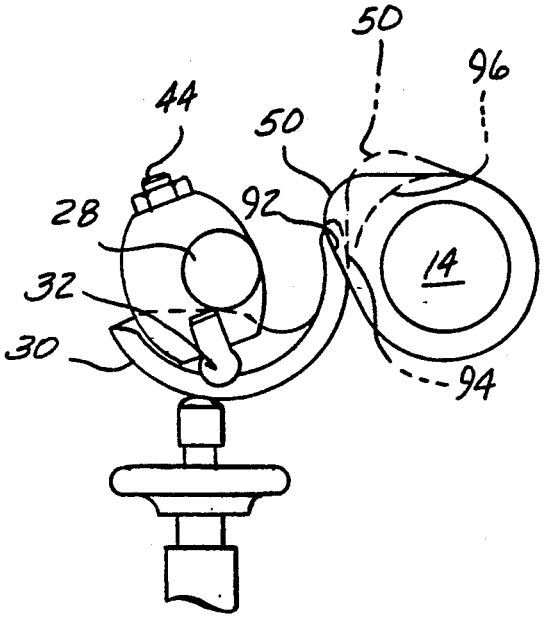
FIG. 7 is a detailed simplified side elevational view of a modified form of the cam follower according to the present invention having a notch formed on the cam follower adjacent one end to clear the cam lobe for early valve closure.
Figure 8:
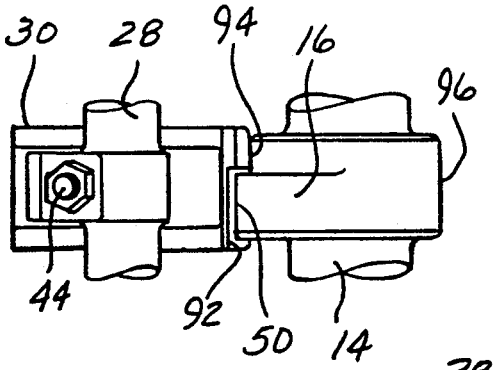
FIG. 8 is a top view of the modified cam follower as shown in FIG. 7 and further showing a annular shoulder contact area adjacent the cam lobe.

Referring now to FIGS. 7 and 8, a modified cam follower 30 is depicted having a notch 92 formed in one end thereof adjacent the cam 16 on the cam shaft 14 when in a slow speed engine position. The cam lobe falls into the notch 92 at a position 15° retarded from the normal valve closure position for slow speed engine operation, so that early valve closure is achieved, or in other words a 220° position with respect to the 0° position previously defined. The notch 92 preferably only extends along a portion of the longitudinal length of the cam follower 30, providing an un-notched contact area 94 which can engage an annular shoulder 96, which may be the circular surface of the cam shaft 14 or an enlarged shoulder surface. When the lobe 50 of cam 16 falls into notch 92 as shown, the full radius area of the cam follower 30 comes to rest on a full diameter land 96 on the cam shaft 14 to maintain proper clearance at the valve. The notch 92 is adjacent the low speed contact surface 38 end of the cam follower 30, such that when the shaft 28 is rotated angularly in a clockwise direction from that shown in FIG. 7, the notch 92 is moved to a position no longer in contact with cam lobe 50. The notch 92 provides an early valve closure, before the cam shaft reaches the 235° position of rotation a shown in FIGS. 3A and 3B without disturbing the other operating characteristics previously described.

Figure 9:
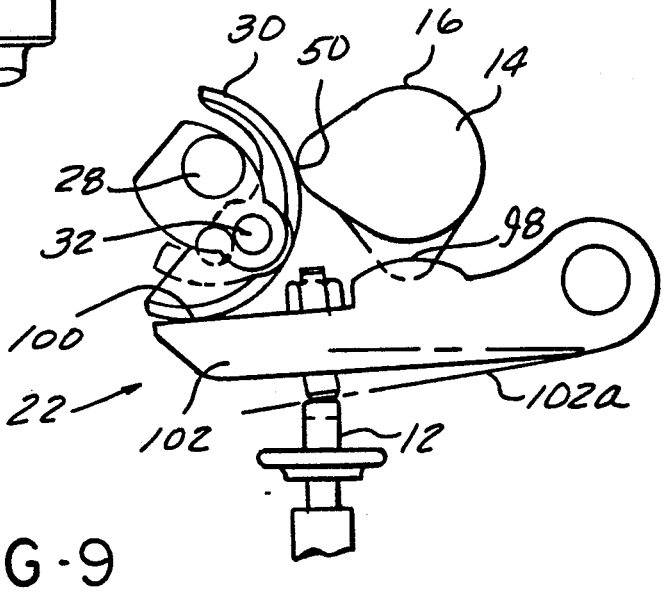
FIG. 9 is a simplified side elevational view of a modified form of the present invention having valve operating means including a rotatable lever engageable with the cam and cam follower for actuating the valve to exhaust air when operating as an air brake.

Referring now to FIG. 9, an alternative embodiment of the invention is shown allowing for use of the present invention as an air brake in diesel engines. In this configuration, the valve operating means 22 includes a reciprocal lever means 102 having a cam follower contact surface and a direct cam contact surface, 98 and 100 respectively. As the cam lobe 50 engages the lever means 102 on the cam contact surface 100 90° before contacting the cam follower 30, the lever means approaches position **102*a*** (shown in phantom) to provide exhaust of air at top dead center when operating as an air brake.

Figure 10:
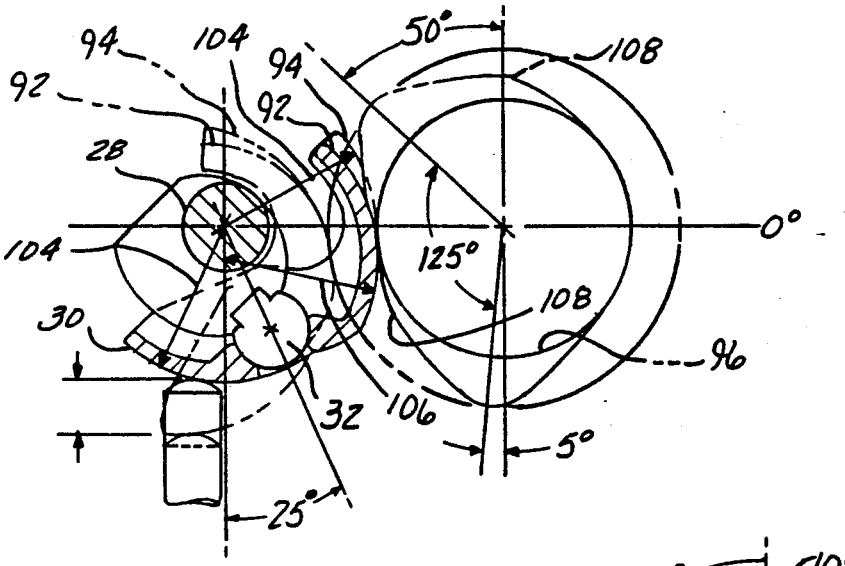
FIG. 10 is a simplified side elevational view of another alternative embodiment of an infinitely variable valve lift cam follower mechanism according to the present invention for modifying the valve lift duration with a cam follower pivot disposed at a maximum swing angle while in a dwell position.
Figure 11:
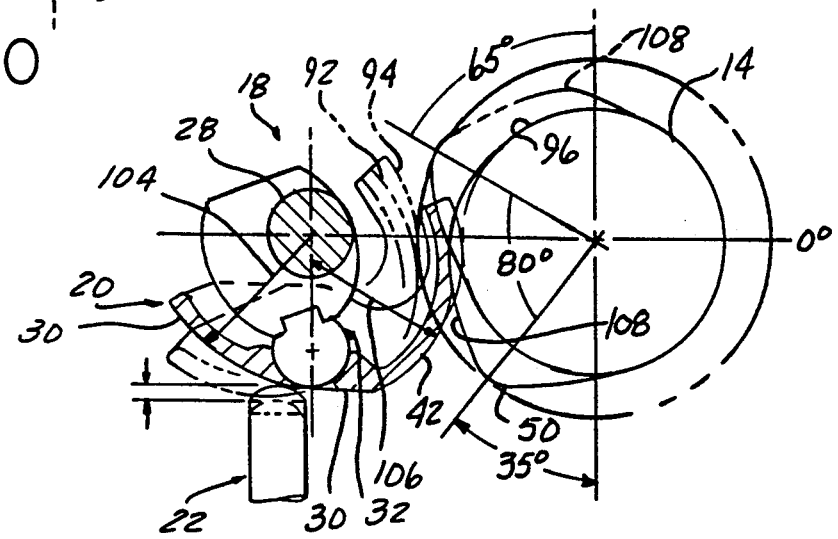
FIG. 11 is a simplified side elevational view of another alternative embodiment of an infinitely variable valve lift cam follower mechanism according to the present invention for modifying the valve lift duration with a cam follower pivot disposed at a minimum swing angle while in a dwell position.

Referring now to FIGS. 10 and 11, another alternative embodiment of the invention is depicted. This embodiment of the invention provides for varying the extent or time of duration of valve opening. The valve open duration is dependent on first and second radii, 104 and 106 respectively, defining the first and second contact surfaces, 38 and 40 disposed along at least a portion of the cam follower 30. The first and second radii may be equal to one another with the origin of one radius offset from the origin of the other radius by a predetermined distance. In the alternative, the radius may be of unequal length with the origin of one radius being offset from the origin of the other radius by a predetermined distance. The first radius 104 can be equal or less than the second radius 106 and can emanate from the same origin or an offset origin. Preferably, the first and second radii, 104 and 106 respectively are equal to one another, but it is anticipated that one radius could be in a range of 90% of the length of the other radius up to and including 100% of the length of the other radius. The offset of the origin of one radius from the origin of the other radius can be in the range from zero offset (with both origins emanating from the same point) to 50% of the length of one of the radii. A close examination of FIGS. 10 and 11 shows a protruding, contoured, leading cam surface 108 which causes valve lift open position to occur earlier than that obtainable without the leading cam surface 108, in combination with first and second radii, 104 and 106, of equal length but having origins offset from one another. This embodiment also includes a notch 92 formed in the cam follower 30 adjacent the low speed contact surface 38 end of the cam follower means 20 to provide early valve closure at slow engine speed as described and illustrated with reference to FIGS. 7 and 8. It is anticipated that the notch 92 may not be required in all configurations of the invention according to this embodiment. The leading cam surface 108 also prevents clicking between the cam and cam follower. The valve stem position may also be moved from that depicted in FIG. 10 to alternative positions, such as that shown at position B in FIG. 2. In other respects, the cam shaft 14, cam 16, actuation member 12 and shaft means 28 are similar to the embodiments previously described above.

The cam follower means 20 is pivotable about pivot means 32. The pivot means 32 is positioned at a maximum swing position of 65° position with respect to the 0° position previously defined (25° in the counterclockwise direction from the vertical axis). This 65° position provides for valve open to occur when the cam lobe 50 reaches the 95° position with respect to the 0° position previously defined and maintains the valve in an open position until the cam lobe 50 reaches the 220° position with respect to the 0° position previously defined. Therefore, the valve is held open for 125° of cam shaft rotation in the high speed position.

Referring now to FIG. 11, the cam follower means 20 is shown with the pivot means 32 in a 90° position with respect to the 0° position previously defined (in other words vertically aligned with respect to a vertical axis of the swing shaft as illustrated). This is defined as a minimum swing angle with the valve actuator means in the position A as illustrated. The valve open occurs at the 125° position of the cam lobe 50 with respect to the 0° position previously defined and a valve close position at the 205° position with respect to the 0° position previously defined. This provides a valve open duration of 80° of cam lobe 50 rotation compared to 125° of valve open duration when pivot means 32 is in the position illustrated in FIG. 10. This effectively provides control of the timing and duration of valve opening and closure while also providing variable valve lift as shown graphically in FIG. 12.

Figure 12:
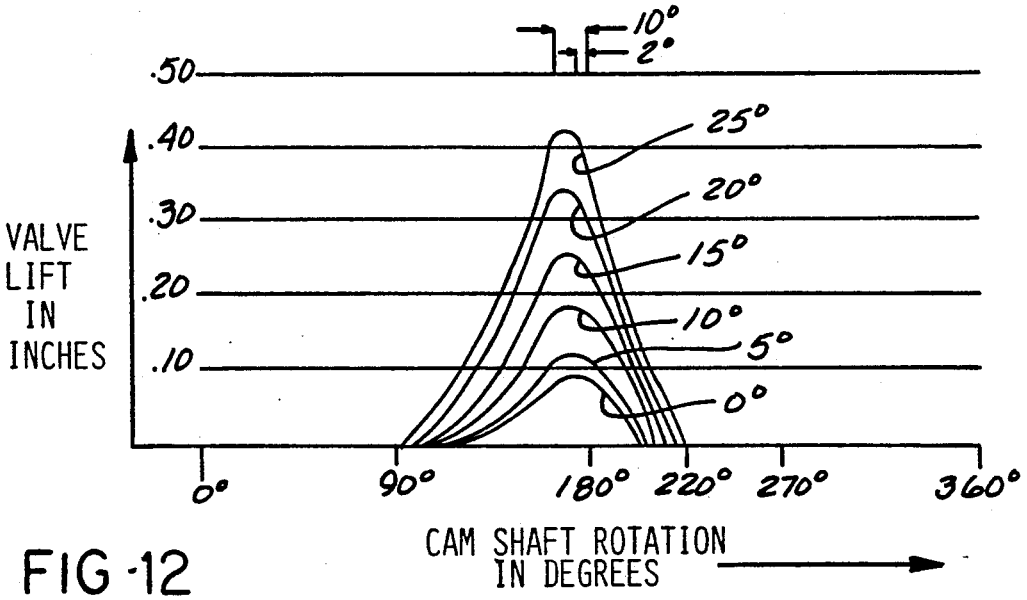
FIG. 12 is a graph showing valve lift in inches corresponding to cam shaft rotation in degrees from a 0° position starting with the cam lobe on the right-hand side of an axis normal to longitudinal axes of both the cam shaft and the swing shaft.

As shown graphically in FIG. 12, this alternative embodiment of the present invention provides for varying the amount of valve lift, the valve timing and valve open duration. FIG. 12 shows the valve lift in inches on the vertical axis and the cam shaft rotation in degrees along the horizontal axis with valve operating means 22 disposed at a position as illustrated in FIGS. 10 and 11. Of course, as previously described with respect to the other embodiments, it is anticipated that the valve operation means 22 may be disposed at a wide variety of locations with respect to swing shaft, cam shaft and cam follower where positions A and B previously illustrated in connection with FIGS. 2, 3A and 3B are just two of virtually an infinite number of angular positions with respect to the swing shaft axis of rotation. Each position provides slightly different valve operating characteristics and further provides slightly different amounts of angular adjustability and valve sensitivity to adjustment of the swing shaft angle of orientation. As can be seen clearly in FIG. 12 the valve open position changes with respect to the angular orientation of the pivot means 32 as illustrated. The lower most curve corresponding to the angular position depicted in FIG. 11 with the pivot means 32 disposed at a 90° position with respect to the 0° position previously defined (in vertical alignment with the longitudinal axis of shaft means 28) and each successive curve illustrating angular displacement of the pivot means 32 in increments of 5° counterclockwise rotation. The uppermost curve illustrating the valve lift with respect to cam shaft rotation when the pivot means is in a position corresponding to that illustrated in FIG. 10.

While the invention has been described in connection with what is presently considered to be the most practical and preferred embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under current law.

I claim:

1. An apparatus for cyclically actuating an actuation member in response to rotation of a camshaft having a cam carried thereon, the apparatus comprising:

cam follower means continuously engaging said cam and having an axis of reciprocation parallel to and offset from an axis of angular displacement, the cam follower means for transmitting infinitely variable reciprocating movement to said actuation member to move said actuation member from a consistent first position to an infinitely variable second position.

2. The apparatus of claim 1 wherein the cam follower means further comprises:

shaft means capable of angular rotation through at least a predetermined arc;

a cam follower carried by the shaft means for rotation therewith; and pivot means for pivotally connecting the cam follower to the shaft means, the pivot means allowing reciprocation of the cam follower independent of angular movement of the shaft means.

3. The apparatus of claim 2 further comprising:

the cam follower having an external curved surface engageable with the cam and the actuation member.

4. The apparatus of claim 2 further comprising:

the pivot means disposed generally between a cam contact surface and an actuation member contact surface.

5. The apparatus of claim 2 further comprising:

means for driving the shaft means in rotation about a longitudinal axis to a selected position on the predetermined arc.

6. The apparatus of claim 5 wherein the driving means further comprises:

a crank arm connected to the shaft means;

a piston connected to the crank arm for driving the crank arm and attached shaft means in rotation through the predetermined arc;

a cylinder housing the piston for reciprocal movement between first and second end limits of movement, the piston and cylinder defining first and second expandable fluid pressure chambers; and means for selectively expanding and retracting the first and second chambers to drive the piston in a desired direction.

7. The apparatus of claim 6 wherein the means for selectively expanding and retracting the first and second chambers further comprises:

a shiftable spool valve operable to apply pressurized fluid to one chamber while evacuating pressurized fluid from the other chamber; and solenoid means for actuating the spool valve.

8. The apparatus of claim 1 wherein the actuation member further comprises:

a valve; and a hydraulic lifter disposed between the valve and the cam follower.

9. The apparatus of claim 1 further comprising:

lever means having a first contact surface with the cam follower means and a second contact surface with the cam, the lever means for actuating the actuation member to exhaust air when operating as an air brake.

10. In an internal combustion engine having a rotatable camshaft, a cam on said camshaft, a combustion chamber and a reciprocable valve member for opening and closing a valve port in communication with the combustion chamber, an apparatus for cyclically actuating the valve member comprising:

valve operating means for reciprocating the valve member;

cam follower means co-operable with the cam and engaging the valve operating means for actuating the valve member, the cam follower means having a first contact surface with the cam and a second contact surface with the valve operating means, the first and second contact surfaces formed as curved surfaces with first and second predetermined radii, respectively; and displaceable pivot means supporting the cam follower means, the pivot means disposed generally between the first and second contact surfaces.

11. The apparatus of claim 10 further comprising:

the first and second predetermined radii originating from a single point for both the first and second contact surfaces.

12. The apparatus of claim 11 further comprising the first radii being shorter than the second radii.

13. The apparatus of claim 11 further comprising the first and second radii being of equal length.

14. The apparatus of claim 10 further comprising the first and second predetermined radii originating from first and second points of origin offset from one another.

15. The apparatus of claim 14 further comprising the first and second radii offset from one another by a distance falling in a range selected between 50% and 100% inclusive of the length of the longest of the two radii.

16. The apparatus of claim 14 further comprising the first radii being shorter than the second radii.

17. The apparatus of claim 14 further comprising the first and second radii being of equal length.

18. The apparatus of claim 10 further comprising:

the first and second contact surfaces forming a single continuous smooth curved surface.

19. The apparatus of claim 10 wherein the valve operating means further comprises:

a hydraulic valve lifter disposed between the cam follower means and a stem of the valve member.

20. The apparatus of claim 10 wherein the valve operating means comprises:

rotatable lever means having a first contact surface with the cam follower means and a second contact surface with the cam, the rotatable lever means for actuating the valve operating means to exhaust air from the combustion chamber at top dead center when operating as an air brake.

21. The apparatus of claim 10 wherein the displaceable pivot means further comprises:

shaft means capable of angular rotation through at least a predetermined arc; and a pivot pin for pivotally connecting the cam follower means to the shaft means, the pivot pin allowing reciprocation of the cam follower means independent of angular rotation of the shaft means.

22. The apparatus of claim 10 wherein the cam follower means further comprises:

a cam follower having a cam lobe clearance notch for providing early valve closure at slow engine speed.

23. The apparatus of claim 10 further comprising:

the first and second contact surfaces disposed along at least a portion of a smooth circular surface of the cam follower at an angle from one another measured from a center of the circular surface falling in the range of not less than 60° and not more the 300°.

24. The apparatus of claim 23 wherein the angle falls in a range from 60° to 135° inclusive.

25. An apparatus for operating at least one valve to vary a valve lift distance and extent of duration of peak valve opening relative to an operating cycle of an internal combustion engine, said valve controlling the flow of fluid with respect to a combustion chamber of said internal combustion engine, said combustion chamber defined by a cylinder in the engine and piston means moveable in the cylinder for varying the volume thereof, said engine also including a rotatable camshaft driven in timed relation with a speed of said engine and means for transmitting reciprocating movement to said valve including cam follower means engaging valve operating means and being operable to effect movement of said valve to an open position, said apparatus comprising:

a swing shaft disposed having a longitudinal axis of rotation parallel to and offset from said camshaft, the swing shaft capable of angular rotation through a predetermined arc, the longitudinal axis of the swing shaft perpendicular to and offset from a longitudinal axis of the valve;

said cam follower means carried by the swing shaft and having an external smooth curved surface with a predetermined radius, the curved surface simultaneously and continuously engageable with the cam and the valve operating means for transmitting reciprocating movement at any position along the predetermined arc of angular rotation of the swing shaft; and pivot means connecting the cam follower means to the swing shaft, the pivot means having an axis of rotation parallel to and offset from the longitudinal axis of the swing shaft, the pivot means disposed generally between the cam and valve operating means for allowing reciprocating rotation of the cam follower means independent of angular rotation of the swing shaft.

26. The apparatus of claim 25 further comprising:

a valve lash adjustment screw connected to the pivot means allowing adjustment of the position of the cam follower means with respect to the cam and valve operating means, such that the valve operating means continuously biases the cam follower means into contact with the cam, wherein angular movement of the swing shaft to position the pivot means closer to the cam increases the valve lift distance, while angular movement of the swing shaft to position the pivot means closer to the valve operating means decreases the valve lift distance.

* * * * *

UNITED STATES PATENT AND TRADEMARK OFFICE

CERTIFICATE OF CORRECTION

PATENT NO. : 5,205,247

DATED : April 27, 1993

INVENTOR(S) : Christopher J. Hoffmann

It is certified that error appears in the above-identified patent and that said Letters Patent is hereby corrected as shown below:

On the title page, item [75]
delete "Christopher J. Hoffman" and insert --Christopher J. Hoffmann--.

Signed and Sealed this

Twelfth Day of December, 1995

*Attest:*

*Attesting Officer*

Bruce Lehman

BRUCE LEHMAN

*Commissioner of Patents and Trademarks*